US008997669B1

(12) United States Patent
Konzak et al.

(10) Patent No.: US 8,997,669 B1
(45) Date of Patent: Apr. 7, 2015

(54) THREAD TENSIONER FOR A SEWING MACHINE

(71) Applicant: Handi Quilter, Inc., North Salt Lake, UT (US)

(72) Inventors: Gary James Konzak, Salem, UT (US); Bryan K. Ruggles, Riverton, UT (US)

(73) Assignee: Handi Quilter, Inc., North Salt Lake, UT (US)

( * ) Notice: Subject to any disclaimer, the term of this patent is extended or adjusted under 35 U.S.C. 154(b) by 0 days.

(21) Appl. No.: 14/515,780

(22) Filed: Oct. 16, 2014

(51) Int. Cl.
*D05B 47/04* (2006.01)
*D05B 47/06* (2006.01)

(52) U.S. Cl.
CPC ..... *D05B 47/04* (2013.01); *D05B 47/06* (2013.01)

(58) Field of Classification Search
CPC ..... D05B 47/04; D05B 47/06
USPC ..... 112/255, 254; 242/150 M, 150 R; 226/195
See application file for complete search history.

(56) References Cited

U.S. PATENT DOCUMENTS

| | | | | | |
|---|---|---|---|---|---|
| 1,020,057 | A | | 3/1912 | Ringe | |
| 2,694,375 | A | | 11/1951 | Attwood | |
| 2,698,590 | A | * | 1/1955 | Garbe | 112/254 |
| 2,741,198 | A | | 4/1956 | Attwood et al. | |
| 3,146,969 | A | * | 9/1964 | Lindsey | 242/150 R |
| 3,206,138 | A | * | 9/1965 | Lindsey | 242/150 R |
| 3,266,449 | A | | 8/1966 | Heinrich et al. | |
| 3,360,213 | A | * | 12/1967 | Hetzel et al. | 242/149 |
| 3,523,433 | A | * | 8/1970 | Hatay | 66/132 T |
| 3,797,426 | A | * | 3/1974 | Von Hagen | 112/254 |
| 3,839,972 | A | | 10/1974 | Scott et al. | |
| 3,875,489 | A | | 4/1975 | Von Brimer | |
| 3,991,954 | A | * | 11/1976 | Schwartz | 242/150 M |
| 4,013,028 | A | | 3/1977 | Murakami | |
| 4,098,208 | A | * | 7/1978 | Hedegaard | 112/291 |
| 4,108,096 | A | | 8/1978 | Ciecior | |
| 4,166,423 | A | * | 9/1979 | Brienza et al. | 112/254 |
| 4,186,676 | A | * | 2/1980 | Villa et al. | 112/165 |
| 4,289,087 | A | * | 9/1981 | Takenoya et al. | 112/254 |
| 4,388,885 | A | | 6/1983 | Dreier | |
| 4,430,953 | A | | 2/1984 | Spies | |
| 4,458,611 | A | | 7/1984 | Arendash | |
| 4,513,674 | A | | 4/1985 | Bhatia et al. | |
| 4,515,096 | A | | 5/1985 | Ingram | |
| 4,523,440 | A | * | 6/1985 | Voisin et al. | 66/146 |
| 4,539,922 | A | | 9/1985 | Klundt | |

(Continued)

FOREIGN PATENT DOCUMENTS

EP 254958 A1 2/1988

*Primary Examiner* — Danny Worrell
(74) *Attorney, Agent, or Firm* — Maschoff Brennan

(57) ABSTRACT

Thread tensioner for a sewing machine. In one example embodiment, a thread tensioner for a sewing machine includes a first disk, a second disk, a spring, a knob, and a sensor. The second disk is positioned next to the first disk. The spring is configured to apply tension to a thread positioned between the first disk and the second disk by exerting a force against the second disk. The spring defines a length between a first end and a second end. The knob is configured, when rotated in one direction, to travel along a threaded shaft toward the spring and thereby cause the length of the spring to shorten. The knob is configured, when rotated in another direction, to travel along the threaded shaft away from the spring and thereby allow the length of the spring to lengthen. The sensor is configured to track a current length of the spring.

20 Claims, 9 Drawing Sheets

(56) References Cited

U.S. PATENT DOCUMENTS

| | | | | | |
|---|---|---|---|---|---|
| 4,554,840 | A | | 11/1985 | Marchesi | |
| 4,616,585 | A | | 10/1986 | Marcandalli | |
| 4,776,293 | A | * | 10/1988 | Yoshida | 112/302 |
| 4,821,199 | A | * | 4/1989 | Kuhnert | 700/141 |
| 4,884,763 | A | * | 12/1989 | Rydborn | 242/148 |
| 5,033,400 | A | * | 7/1991 | Fischer | 112/254 |
| 5,086,719 | A | | 2/1992 | Ogawa | |
| 5,092,257 | A | | 3/1992 | Ogawa | |
| 5,097,775 | A | | 3/1992 | Ogawa et al. | |
| 5,294,071 | A | * | 3/1994 | Hartel et al. | 242/150 M |
| 5,320,053 | A | | 6/1994 | Beasley | |
| 5,549,062 | A | | 8/1996 | Yamashita et al. | |
| 5,611,499 | A | * | 3/1997 | Stokes et al. | 242/419.4 |
| 5,651,287 | A | | 7/1997 | Tseng | |
| 5,842,661 | A | * | 12/1998 | Hohne et al. | 242/419.1 |
| 5,870,960 | A | | 2/1999 | Brown | |
| 6,065,711 | A | * | 5/2000 | Plath | 242/419.4 |
| 6,089,172 | A | * | 7/2000 | Takenoya et al. | 112/470.04 |
| 6,095,449 | A | * | 8/2000 | Gallo et al. | 242/365.4 |
| 6,748,888 | B1 | | 6/2004 | Chen | |
| 7,007,777 | B2 | * | 3/2006 | Gonser et al. | 188/65.2 |
| 7,124,697 | B2 | * | 10/2006 | Foley | 112/255 |
| 7,597,058 | B2 | | 10/2009 | Ishikawa et al. | |
| 7,654,209 | B2 | | 2/2010 | Park | |
| 7,661,624 | B2 | * | 2/2010 | Akaro et al. | 244/17.23 |
| 7,720,552 | B1 | | 5/2010 | Lloyd | |
| 7,845,295 | B2 | | 12/2010 | Park | |
| 7,878,133 | B2 | | 2/2011 | Tokura et al. | |
| 7,971,543 | B2 | | 7/2011 | Nagai et al. | |
| 8,096,251 | B2 | | 1/2012 | Suzuki | |
| 8,448,588 | B1 | * | 5/2013 | Lindley | 112/254 |
| 2003/0117380 | A1 | | 6/2003 | Kanzaki | |
| 2003/0172860 | A1 | | 9/2003 | Kong | |
| 2005/0178307 | A1 | | 8/2005 | Frazer et al. | |
| 2007/0261621 | A1 | | 11/2007 | Suzuki et al. | |
| 2008/0211779 | A1 | | 9/2008 | Pryor | |
| 2008/0216725 | A1 | | 9/2008 | Tokura et al. | |
| 2008/0281442 | A1 | | 11/2008 | Huckemann et al. | |
| 2009/0199752 | A1 | | 8/2009 | James et al. | |
| 2009/0249990 | A1 | | 10/2009 | Park | |
| 2010/0126396 | A1 | | 5/2010 | Stutznacker | |
| 2011/0029865 | A1 | | 2/2011 | Gilland et al. | |
| 2012/0097083 | A1 | | 4/2012 | James et al. | |
| 2012/0226977 | A1 | | 9/2012 | Lengeling et al. | |
| 2012/0312213 | A1 | | 12/2012 | Konzak et al. | |
| 2012/0318181 | A1 | | 12/2012 | Kasa | |
| 2013/0249814 | A1 | | 9/2013 | Zeng | |
| 2014/0266569 | A1 | | 9/2014 | Yoshikawa et al. | |
| 2014/0270256 | A1 | | 9/2014 | Yoshikawa et al. | |

* cited by examiner

THREAD TENSIONER FOR A SEWING MACHINE

FIELD

The embodiments disclosed herein relate to a thread tensioner for a sewing machine.

BACKGROUND

Sewing machines generally function to form a row of stitches in one or more layers of fabric using a combination of thread from a spool, also known as top thread, and thread from a bobbin, also known as bottom thread. In order to form a row of stitches that are uniform on both sides of the one or more layers of fabric, a consistent tension must be applied to the top thread and to the bottom thread so that the same amount of top thread and bottom thread flow from the spool and the bobbin simultaneously during the operation of the sewing machine. Achieving consistent tension in the top and bottom threads is generally accomplished by running the top and bottom threads through one or more tension devices of the sewing machine, sometimes known as thread tensioners. A typical thread tensioner for the top thread on a sewing machine includes a knob that can be manually rotated by a user in order to adjust the tension on the top thread. Typically, as the knob is rotated in one direction, the tension on the top thread increases, and as the knob is rotated in the other direction, the tension on the top thread decreases.

One common difficulty faced by a user of a typical thread tensioner is knowing how many rotations and/or partial rotations of the knob are necessary to achieve optimal tension on the top thread. This difficulty is due in part to threads of different type requiring different tension settings. Since the thread tensioner may need adjustment as the user switches from one type of thread to another, replicating an optimal tension on a particular type of thread may require the user to track the number of rotations and/or partial rotations of the knob, for example, and then remember this number of rotations and/or partial rotations the next time the same particular type of thread is used. This can be a cumbersome process fraught with errors. It may therefore be difficult for a user of a typical thread tensioner to achieve optimal tension on the top thread while operating a sewing machine.

The subject matter claimed herein is not limited to embodiments that solve any disadvantages or that operate only in environments such as those described above. Rather, this background is only provided to illustrate one example technology area where some embodiments described herein may be practiced.

SUMMARY

In general, example embodiments described herein relate to a thread tensioner for a sewing machine. The example thread tensioner disclosed herein may include a knob, first and second disks between which a thread may be positioned, a spring configured to exert a force against the second disk, and a sensor. As the knob is rotated, causing the length of the spring to be shortened or lengthened, the sensor may be configured to track a current length of the spring. The current length of the spring may be used to determine the current amount of force that the spring is exerting on the second disk, and the corresponding current tension being applied to the thread that is positioned between the first and second disks. The current tension can be displayed to a user in real time, which may enable a user to rotate the knob to the precise rotational position that corresponds to an optimal tension for a particular type of thread.

In one example embodiment, a thread tensioner for a sewing machine includes a first disk, a second disk, a spring, a knob, and a sensor. The second disk is positioned next to the first disk. The spring is configured to apply tension to a thread positioned between the first disk and the second disk by exerting a force against the second disk. The spring defines a first end, a second end, and a length between the first end and the second end. The knob is configured, when rotated in a first direction, to travel along a threaded shaft toward the spring and thereby cause the length of the spring to shorten. The knob is further configured, when rotated in a second direction, to travel along the threaded shaft away from the spring and thereby allow the length of the spring to lengthen. The sensor is configured to track a current length of the spring.

In another example embodiment, a thread tensioner for a sewing machine includes a first disk, a second disk, a hollow threaded shaft, a spring, and a sensor. The second disk is positioned next to the first disk. The spring is configured to apply tension to a thread positioned between the first disk and the second disk by exerting a force against the second disk. The spring defines a first end, a second end, and a length between the first end and the second end. The spring includes a rod extending from the first end of the spring and through the hollow threaded shaft. The knob is configured, when rotated in a first direction, to travel along the threaded shaft toward the spring and thereby cause the length of the spring to shorten and cause the rod to extend further through the hollow threaded shaft in inverse proportion to the shortening of the length of the spring. The knob is further configured, when rotated in a second direction, to travel along the threaded shaft away from the spring and thereby allow the length of the spring to lengthen and allow the rod to retract into the hollow threaded shaft in inverse proportion to the lengthening of the length of the spring. The sensor is configured to track a current length of the spring by tracking a position of an end of the rod.

In yet another example embodiment, a sewing machine includes a spool holder, a needle bar configured to have a needle attached thereto, an electric motor, a thread tensioner, a processor, and a display device. The electric motor is configured, while the needle is threaded with a top thread from a spool on the spool holder, to repeatedly drive the threaded needle through a fabric to form a row of stitches in the fabric. The thread tensioner includes a first disk, a second disk, a spring, and a sensor. The second disk is positioned next to the first disk. The spring is configured, while the top thread is positioned between the first disk and the second disk, to apply tension to the top thread by exerting a force against the second disk. The spring defines a first end, a second end, and a length between the first end and the second end. The knob is configured, when rotated in a first direction, to travel along a threaded shaft toward the spring and thereby cause the length of the spring to shorten. The knob is further configured, when rotated in a second direction, to travel along the threaded shaft away from the spring and thereby allow the length of the spring to lengthen. The sensor is configured to track a current length of the spring. The processor is in electronic communication with the sensor and is configured to determine a current tension that the first disk is exerting on the top thread given the current length of the spring. The display device is in electronic communication with the processor and is configured to display the current tension.

It is to be understood that both the foregoing general description and the following detailed description are exemplary and explanatory and are not restrictive of the invention as claimed.

BRIEF DESCRIPTION OF THE DRAWINGS

Example embodiments will be described and explained with additional specificity and detail through the use of the accompanying drawings in which.

DESCRIPTION OF EMBODIMENTS

Figure 1A:
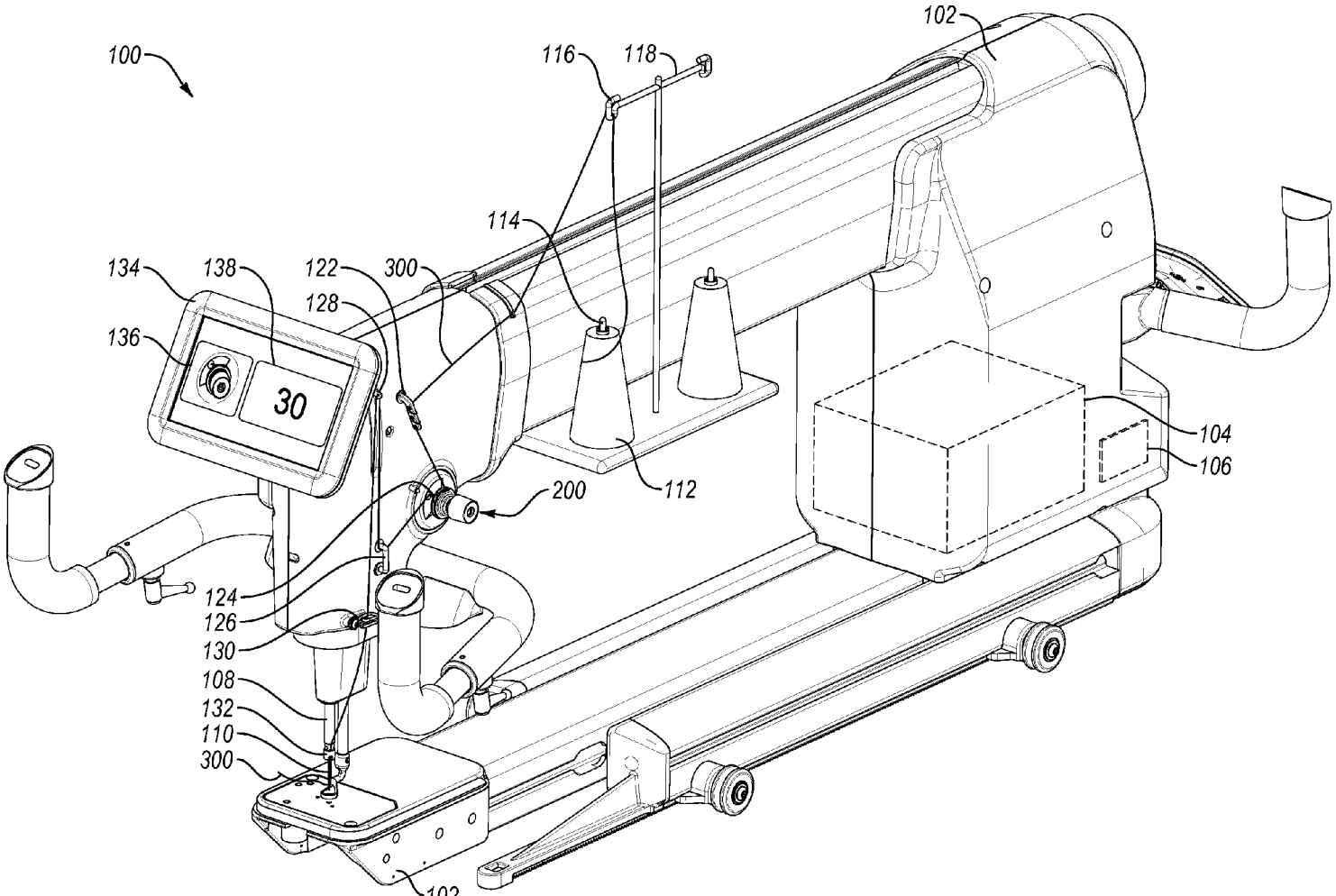
FIG. 1A is a front perspective view of an example sewing machine including an example thread tensioner.
Figure 1B:
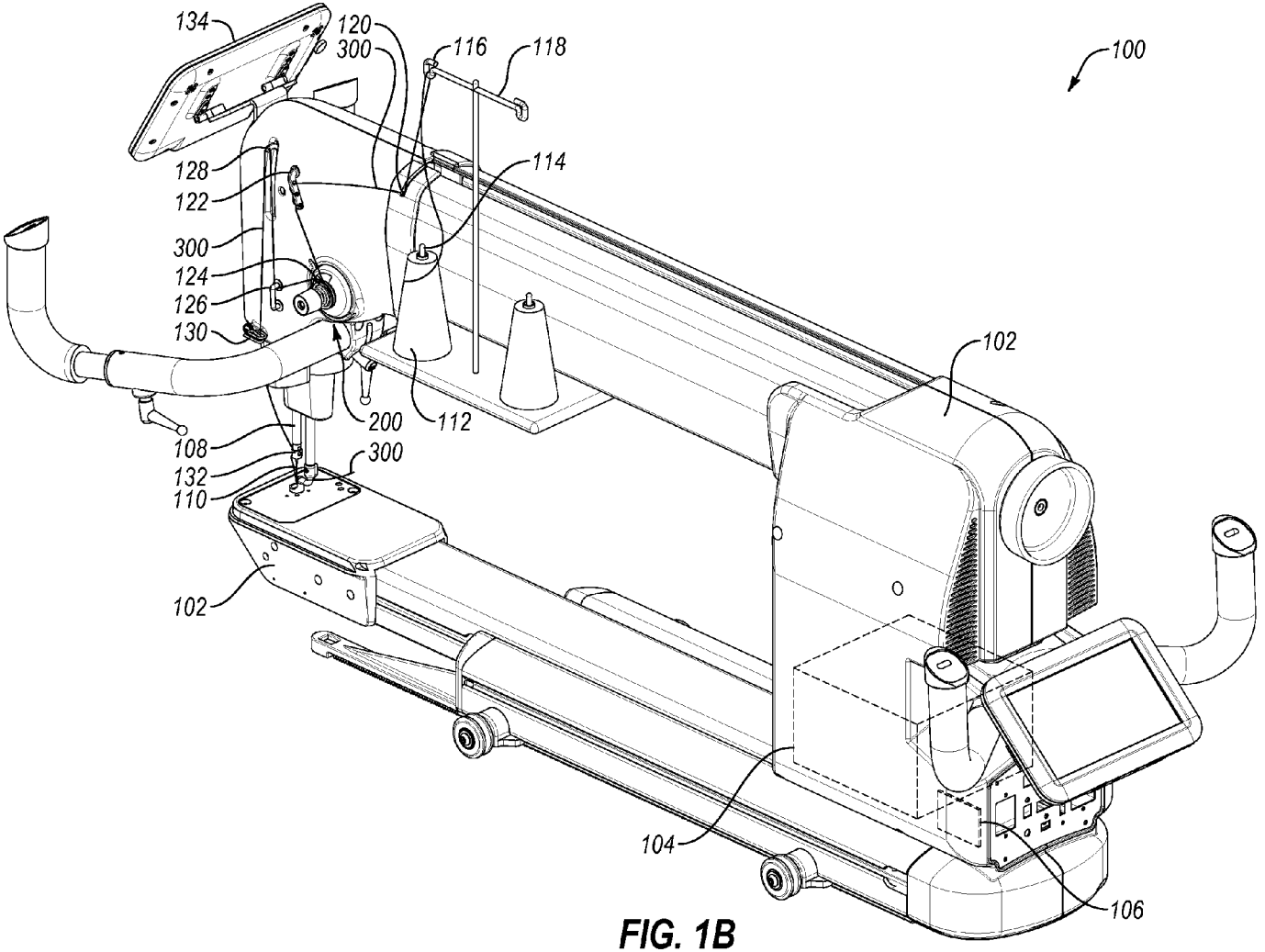
FIG. 1B is a rear perspective view of the example sewing machine of FIG. 1A.

FIG. 1A is a front perspective view of an example sewing machine 100 including an example thread tensioner 200, and FIG. 1B is a rear perspective view of the example sewing machine 100. The example sewing machine 100 of FIGS. 1A and 1B is specialized for quilting and is known as a long-arm quilting machine. Quilting typically involves stitching together multiple layers of fabric to form a quilt. A quilt typically includes a layer of batting sandwiched in between upper and lower layers of fabric.

As disclosed in FIGS. 1A and 1B, the sewing machine 100 may include one or more housings 102 which house various internal components such as an electric motor 104 and a processor 106. The sewing machine 100 may also include the example thread tensioner 200 and an example display device 134. The example display device 134 may be any type of electronic display device, such as a liquid crystal display (LCD) capacitive touchscreen or other touchscreen input/output display device, and may be integral to or separable from the sewing machine 100. The sewing machine 100 may also include a needle bar 108 that is configured to have a needle 110 attached thereto. The needle 110 may be configured to be threaded with a top thread 300.

The threading of the needle 110 with the top thread 300 may be accomplished as follows. First, a spool 112 of the top thread 300 may be placed on a spool holder 114, which in the illustrated embodiment is known as a spool pin. Next, the top thread 300 may be passed through an eyelet 116 of a thread mast 118, a thread guide 120, and a three-hole thread guide 122. Then, the top thread 300 may be positioned between opposing disks of the example thread tensioner 200 by "flossing" the top thread 300 between the opposing disks, as discussed in greater detail below in connection with FIGS. 2A-3C. Next, the top thread 300 may be passed through a take-up spring 124, a stirrup 126, a take-up lever 128, a thread guide 130, and a thread guide 132. Finally, the top thread 300 may be threaded through the eye of the needle 110.

Although not shown in FIGS. 1A and 1B, it is understood that the sewing machine may also include a bobbin case configured to hold a bobbin that is wound with bottom thread, and a bobbin hook, both generally positioned in the housing 102 underneath the needle 110.

During operation of the sewing machine 100, the electric motor 104 may be configured to repeatedly drive the threaded needle 110 through one or more layers of fabric (not shown). Simultaneously, the electric motor 104 may be configured to repeatedly drive the bobbin hook to catch the top thread 300 (which has been driven through the one or more layers of fabric) and loop the top thread 300 around the bobbin to form a row of stitches of the top thread 300 and the bottom thread in the one or more layers of fabric.

In order for this row of stitches to be uniform on both sides of the one or more layers of fabric, a consistent tension must be applied to the top thread 300 and to the bottom thread so that the same amount of top thread 300 and bottom thread flow from the spool 112 and the bobbin simultaneously during operation of the sewing machine 100. Achieving consistent tension in the bottom thread may generally be accomplished using a bottom thread tensioner (not shown) that functions in connection with the bobbin holder. Achieving consistent tension in the top thread 300 may generally be accomplished using the example thread tensioner 200.

As discussed in greater detail below in connection with FIGS. 2A-3C, a sensor of the example thread tensioner 200 of FIGS. 1A and 1B may be configured to track a current length of a spring of the example thread tensioner 200. The processor 106 may be in electronic communication with the sensor of the example thread tensioner 200 and may be configured to determine a current tension that is being applied to the top thread 300 by the example thread tensioner 200 given the current length of the spring of the example thread tensioner 200. The display device 134 may be in electronic communication with the processor 106 and may be configured to display the current tension in real time, by displaying the current tension as a number 138 next to a picture 136 of the example thread tensioner 200 on the display device 134. This real-time display of the current tension may enable a user to rotate a knob of the example thread tensioner 200 to the precise rotational position that corresponds to an optimal tension for the particular type of the top thread 300.

Although the example sewing machine 100 of FIGS. 1A and 1B is a long-arm quilting machine, it is understood that the sewing machine 100 of FIGS. 1A and 1B is only one of countless sewing machines in which the example thread tensioner 200 may be employed. The scope of the example thread tensioner 200 is therefore not intended to be limited to employment in any particular sewing machine.

Figure 2A:
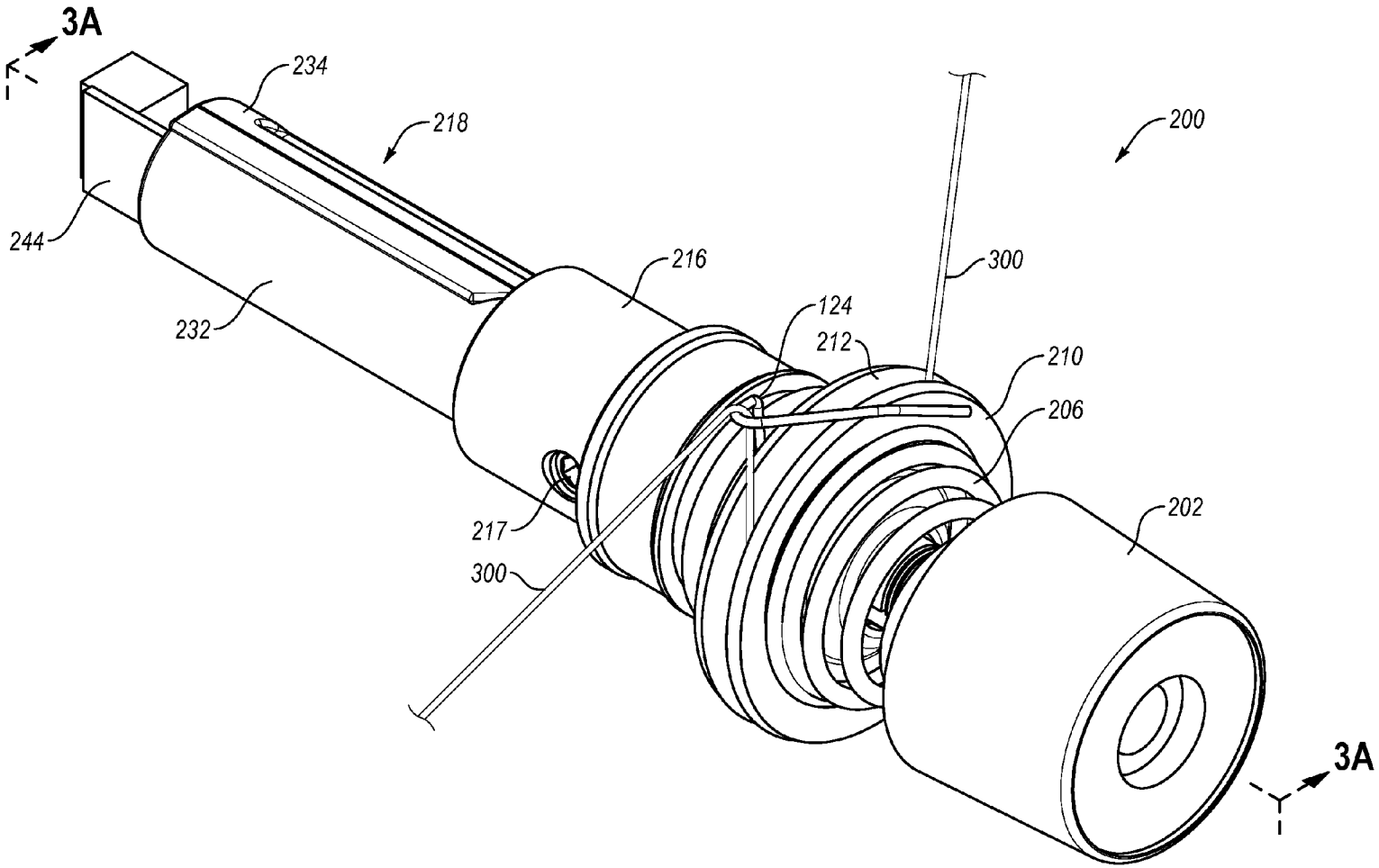
FIG. 2A is a perspective view of the example thread tensioner of FIG. 1A including an example spring.
Figure 2B:
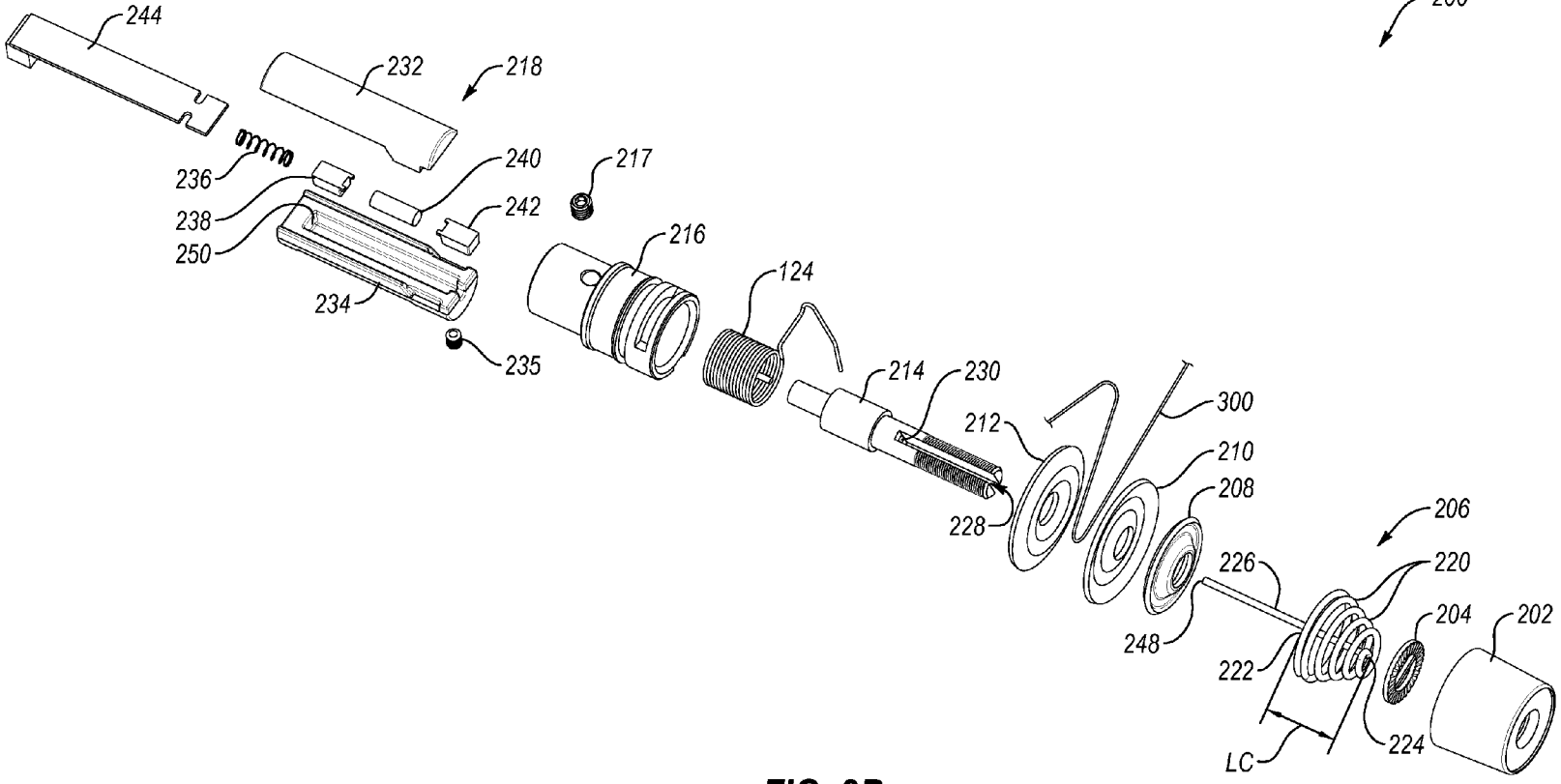
FIG. 2B is an exploded perspective view of the example thread tensioner of FIG. 2A.

FIG. 2A is a perspective view of the example thread tensioner 200 and FIG. 2B is an exploded perspective view of the example thread tensioner 200. As disclosed in FIGS. 2A and 2B, the example thread tensioner 200 may include a knob 202, a knob plate 204, a spring 206, a spring plate 208, a second disk 210, a first disk 212, a shaft 214, the take-up spring 124, a body 216, and a magnetic sensor 218. Also illustrated in FIGS. 2A and 2B is a portion of the top thread 300, which may be positioned between the first disk 212 and the second disk 210.

As disclosed in FIGS. 2A and 2B, the knob 202 is configured, when rotated in clockwise direction, to travel along threads on the shaft 214 toward the spring 206. As the knob 202 travels along the shaft 214 toward the spring 206, the knob 202 forces the knob plate 204 against the spring 206, the spring 206 forces the spring plate 208 against the second disk 210, and the second disk 210 forces the first disk 212 against the body 216, which causes the spring 206 to compress. As disclosed in FIG. 2B, a fastener 217 may be employed where the body 216 includes multiple pieces to secure one piece to another.

The spring 206 defines coils 220, a first end 222 that is configured to be positioned next to the spring plate 208, and a second end 224 that is configured to be positioned next to the knob plate 204. The spring 206 may also define a length LC of the coils 220 between the first end 222 and the second end 224 of the spring 206. The length LC of the coils 220, also referred to herein as the length of the spring 206, may shorten or lengthen as the knob 202 is rotated, as discussed below in connection with FIGS. 3A-3C. The coils 220 of the spring 206 may at least partially surround the shaft 214. In addition, the spring may also define a rod 226 extending from the second end 224 and that extends through a slot 228 of the shaft 214 and through a hollow portion 230 of the shaft 214. As discussed in greater detail below in connection with FIGS. 3A-3C, the length LR of the portion of the rod 226 extending from the hollow portion 230 of the shaft 214 increases in inverse proportion as the length LC of the spring 206 decreases due to the compression of the spring 206.

As disclosed in FIGS. 2A and 2B, the magnetic sensor 218 includes a first housing 232, a second housing 234, a spring 236, a first spacer 238, a magnet 240, a second spacer 242, and a printed circuit board 244. As disclosed in FIG. 2B, a fastener 235 may be employed to securely attach the magnetic sensor 218 to the body 216. The first housing 232 and the second housing 234 define an opening 246 into which the portion of the rod 226 extending from the hollow portion 230 of the shaft 214 extends. As discussed in greater detail below in connection with FIGS. 3A-3C, as the spring 206 is compressed, which causes the length LC of the spring 206 to shorten by a particular amount, the length LR of the portion of the rod 226 extending from the hollow portion 230 of the shaft 214 is lengthened by an equal amount. Similarly, as the spring 206 is extended, which causes the length LC of the spring 206 to lengthen by a particular amount, the length LR of the portion of the rod 226 extending from the hollow portion 230 of the shaft 214 is shortened by an equal amount. As the length LR of the portion of the rod 226 extending from the hollow portion 230 of the shaft 214 is lengthened, an end 248 of the rod 226 is forced against the second spacer 242, the second spacer 242 is forced against the magnet 240, the magnet 240 is forced against the first spacer 238, the first spacer 238 is forced against the spring 236, and the spring 236 is forced against a stop 250 defined by the second housing 234, which causes the spring 236 to compress, allowing the magnet 240 to slide alongside the printed circuit board 244 away from the end 248 of the rod 226. Similarly, as the length LR of the portion of the rod 226 extending from the hollow portion 230 of the shaft 214 is shortened, the load in the spring 236 forces the first spacer 238 against the magnet 240, the magnet 240 is forced against the second spacer 242, and the second spacer is forced against the end 248 of the rod 226, allowing the magnet 240 to slide alongside the printed circuit board 244 toward the end 248 of the rod 226. The printed circuit board 244 may include circuitry, such as a magnetic sensor chip 245, that measures the precise movement of the magnet 240 alongside the printed circuit board 244, which corresponds directly to changes in the length LR of the portion of the rod 226 extending from the hollow portion 230 of the shaft 214, which corresponds inversely to changes in the length LC of the spring 206 due to the rotation of the knob 202 by a user. Therefore, the magnetic sensor 218 may be employed to track a current length of the spring 206. In at least some embodiments, the first spacer 238 and the second spacer 242 may be made from a dielectric material, such as a dielectric plastic material, in order to avoid disturbing the magnetic field of the magnet 240. Further, in at least some example embodiments, the magnetic sensor 218 may be capable of detecting about 75 different rotational positions per rotation of the knob 202, although the magnetic sensor 218 may be configured to detect more or less than 75 rotational positions per rotations, depending on the granularity desired for a particular application.

Figure 3A:
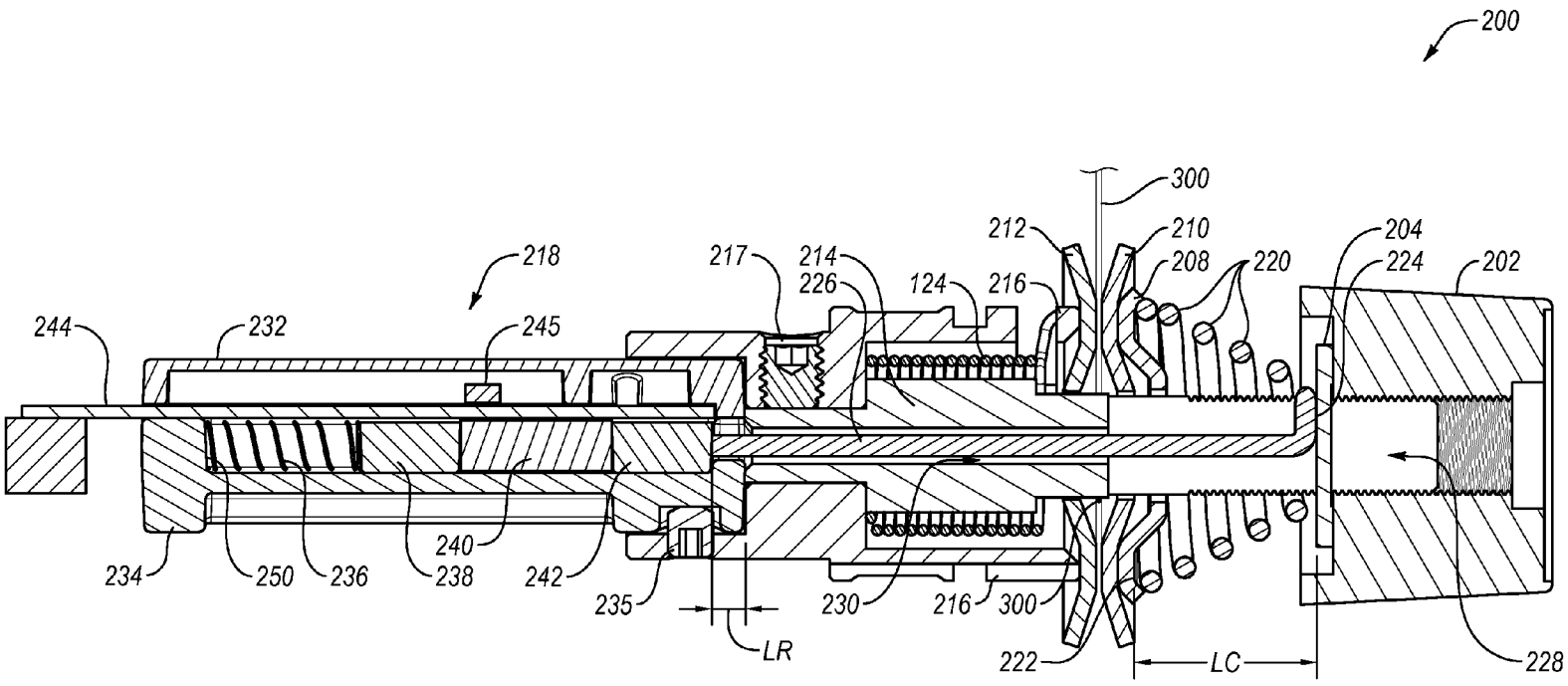
FIG. 3A is a cross-sectional side view of the example thread tensioner of FIG. 2A with the example spring in an uncompressed state.
Figure 3B:
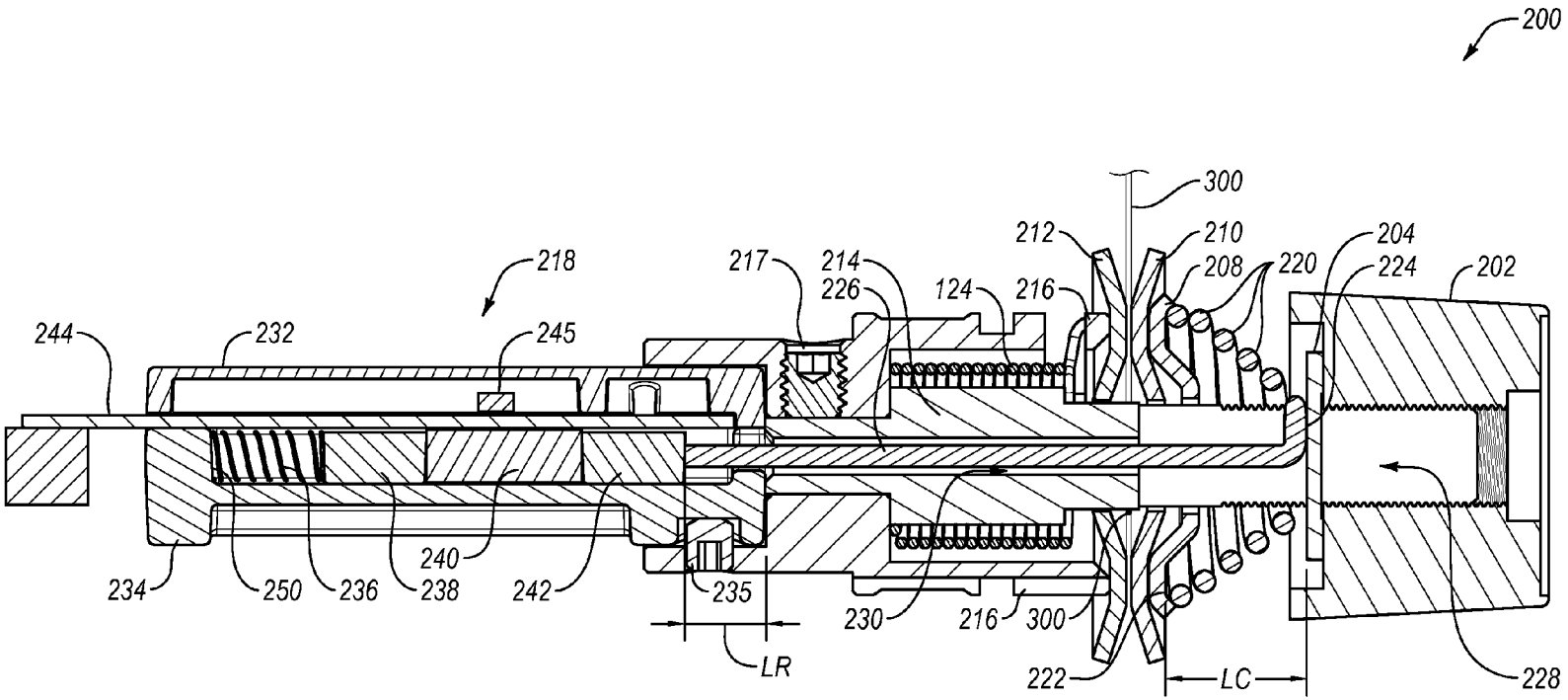
FIG. 3B is a cross-sectional side view of the example thread tensioner of FIG. 2A with the example spring in a partially compressed state.
Figure 3C:
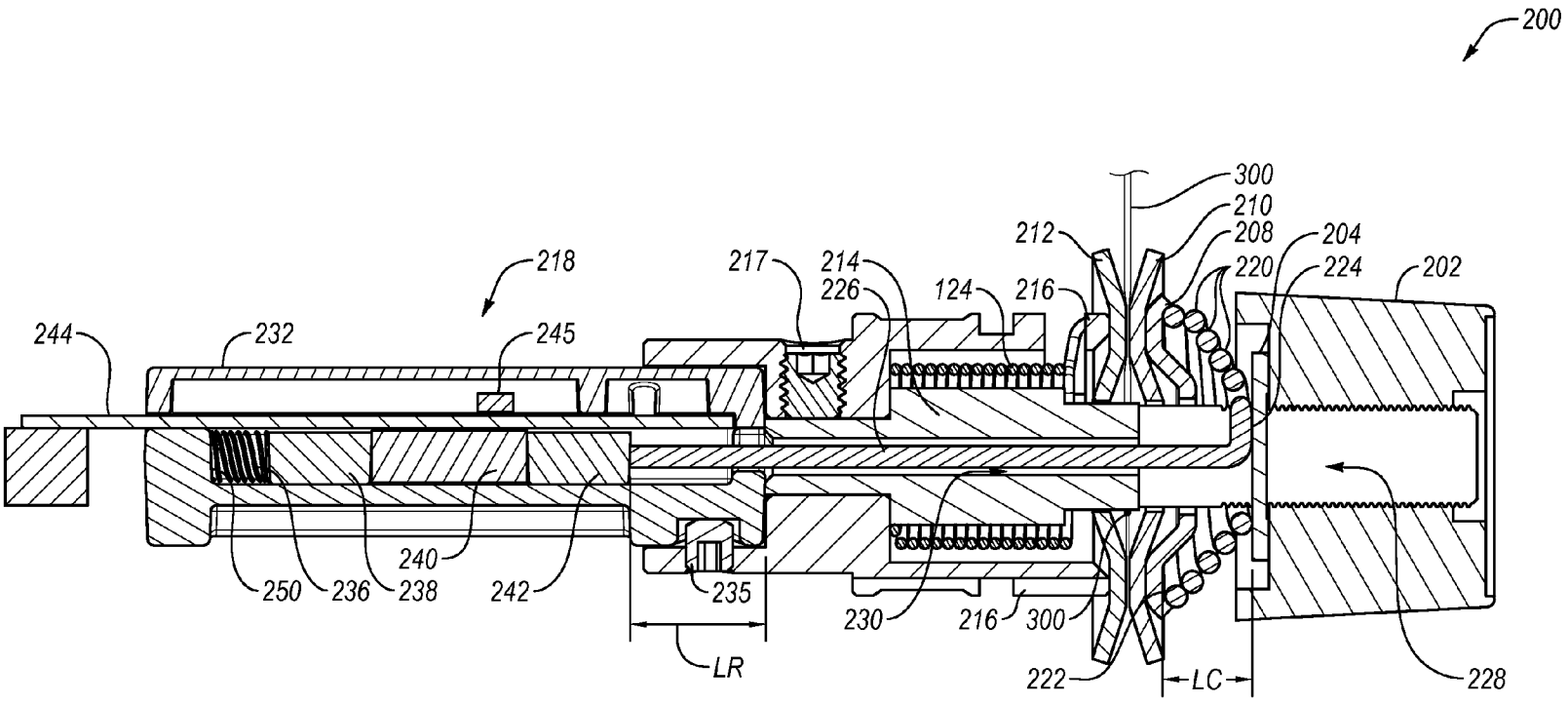
FIG. 3C is a cross-sectional side view of the example thread tensioner of FIG. 2A with the example spring in a fully compressed state.

FIG. 3A is a cross-sectional side view of the example thread tensioner 200 with the example spring 206 in an uncompressed state, FIG. 3B is a cross-sectional side view of the example thread tensioner 200 with the example spring 206 in a partially compressed state, and FIG. 3C is a cross-sectional side view of the example thread tensioner 200 with the example spring 206 in a fully uncompressed state.

As disclosed in the progression from FIG. 3A to FIG. 3C, as the knob 202 is turned in a clockwise direction, the spring 206 is configured to apply tension to the top thread 300 that is positioned between the first disk 212 and the second disk 210 by exerting a force against the second disk 210. In particular, as disclosed in the progression from FIG. 3A to FIG. 3C, as the knob 202 is rotated in a clockwise direction, the knob 202 may be configured to travel along the threads on the shaft 214 toward the spring 206 and thereby cause the length LC of the spring 206 to shorten, due to compression of the spring 206, and cause the length LR of the rod 226 that extends from the hollow portion 230 of the shaft 214 to lengthen in inverse proportion to the shortening of the length LC of the spring 206, due to the loading of the spring 206.

Similarly, as disclosed in the reverse progression from FIG. 3C to FIG. 3A, as the knob 202 is rotated in a counterclockwise direction, the knob 202 is configured to travel along the threads on the shaft 214 away from the spring 206 and thereby allow the length LC of the spring 206 to lengthen and allow the length LR of the rod 226 that extends from the hollow portion 230 of the shaft 214 to shorten in inverse proportion to the lengthening of the length LC of the spring 206, due to the unloading of the spring 206.

As the knob 202 is being rotated by the user, the magnetic sensor 218 is configured to track the current length LC of the spring 206. This tracking may be accomplished by the magnetic sensor 218 tracking a position of the end 248 of the rod 226 as it interacts with the magnet 240. In particular, since the magnetic sensor 218 is configured to track the precise movement of the magnet 240 alongside the printed circuit board 244, since the movement of the magnet 240 corresponds directly to the changes in the length LR of the portion of the rod 226 extending from the hollow portion 230 of the shaft 214, and since the length LR of the portion of the rod 226 extending from the hollow portion 230 of the shaft 214 corresponds inversely to changes in the length LC of the spring 206 due to the rotation of the knob 202 by a user, the magnetic sensor 218 is configured to track the current length LC of the spring 206. For example, where the current length LC of the spring 206 goes from 11 mm in the uncompressed state of FIG. 3A to 5 mm in the fully compressed state of FIG. 3C, the length LR would go from 2 mm to 8 mm. At the same time, the magnet 240 will have shifted 6 mm to the right of a known position that represents the known length of 11 mm of the spring 206 in the uncompressed state, and the circuitry on the printed circuit board 244 will track this movement of the magnet 240 of 6 mm to the right. This tracking allows the magnetic sensor 218 to track the current length LC of the spring 206 in FIG. 3C to be 6 mm less than the 11 mm known length of the spring 206 in the uncompressed state of FIG. 3A, resulting in a tracking of the current length LC of the spring 206 in FIG. 3C as being 5 mm.

As noted above, the processor 106 disclosed in connection with FIG. 1A may be in electronic communication with the magnetic sensor 218 and may be configured to determine a current tension that is being applied to the top thread 300 given the current length LC of the spring 206. This determination may be made by the processor 106 calculating the current load of the spring 206 given the difference between the free length of the spring 206, which is the length of the coils 220 of the spring 206 in the unloaded and uncompressed state of FIG. 3C, and the current length LC of the spring, as determined by the magnetic sensor 218. Further, the display device 134 disclosed in FIG. 1A may be in electronic communication with the processor 106 and may be configured to display the current tension. The current tension may be displayed in terms of the number 138 in units that are unique to the sewing machine 100, or may be displayed in terms of a number in standard units that may be used to describe the amount of tension on a piece of thread. The sewing machine 100 with the example thread tensioner 200 and the display device 134 may therefore be employed by a user to rotate the knob 202 to the precise rotational position that corresponds to an optimal tension for a particular type of top thread 300.

It is understood that the magnetic sensor 218 disclosed herein may be replaced with any other sensor that is configured to track the current length LC of the spring 206. For example, FIG. 4 is a schematic illustration of an example slide potentiometer sensor 400 that could replace the magnetic sensor 218 and FIG. 5 is a schematic illustration of an example photodiode array sensor 500 that could replace the magnetic sensor 218.

Figure 4:
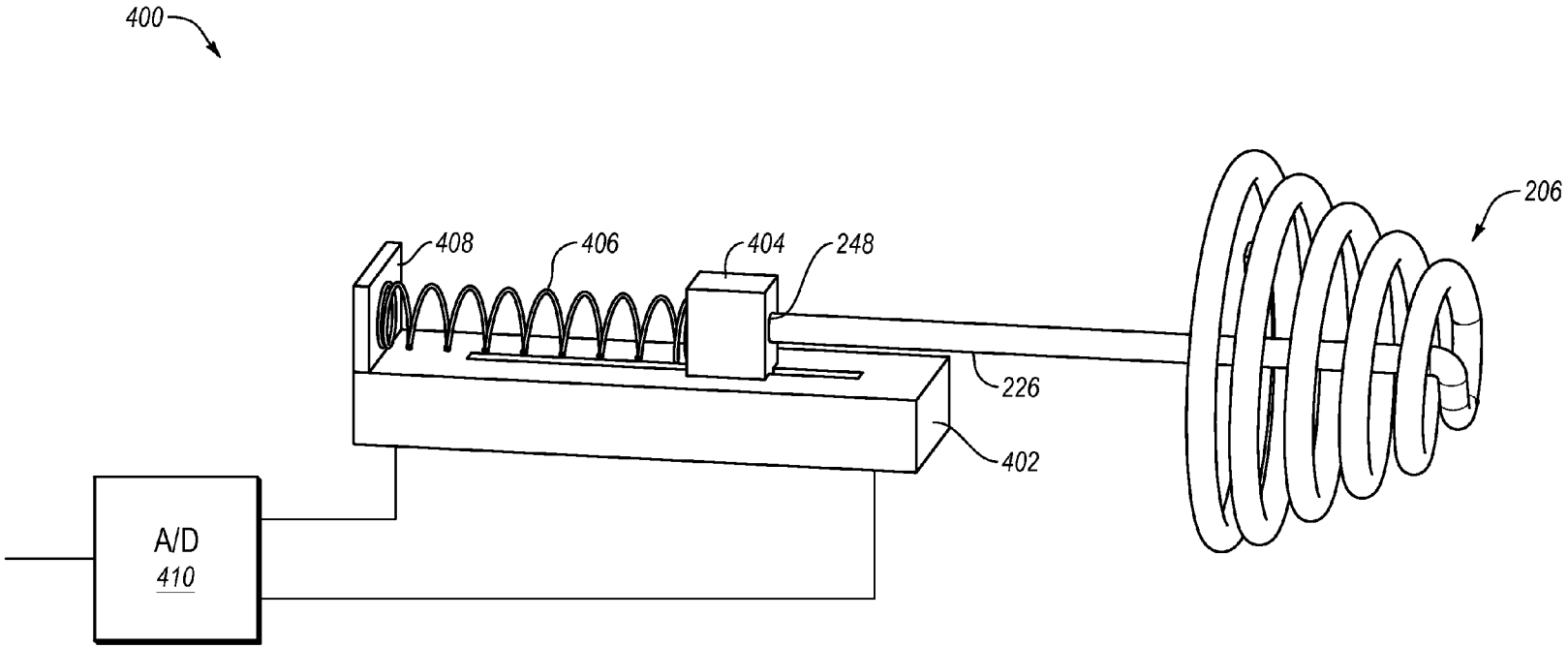
FIG. 4 is a partial schematic illustration of an example slide potentiometer sensor.

As disclosed schematically in FIG. 4, the example slide potentiometer sensor 400 may include a base 402, a lever actuator 404, a spring 406, a stop 408, and an analog to digital (A/D) converter 410. As the end 248 of the rod 226 of the spring 206 is forced against the lever actuator 404, slide potentiometer circuitry (not shown) in the base 402 may track the precise movement of the lever actuator 404. As the end 248 of the rod 226 moves away from the lever actuator 404, a load in the spring 406 forces the lever actuator 404 against the end 248 of the rod 226 to ensure that the lever actuator 404 tracks the precise movement of the end 248 of the rod 226. The A/D converter 410 may then be employed to convert the analog signal produced by the slide potentiometer circuitry in the base 402 into a digital signal. The example slide potentiometer sensor 400 of FIG. 4 may therefore function in a similar manner to the magnetic sensor 218 of FIGS. 2A-3C to track a current length of the spring 206.

Figure 5:
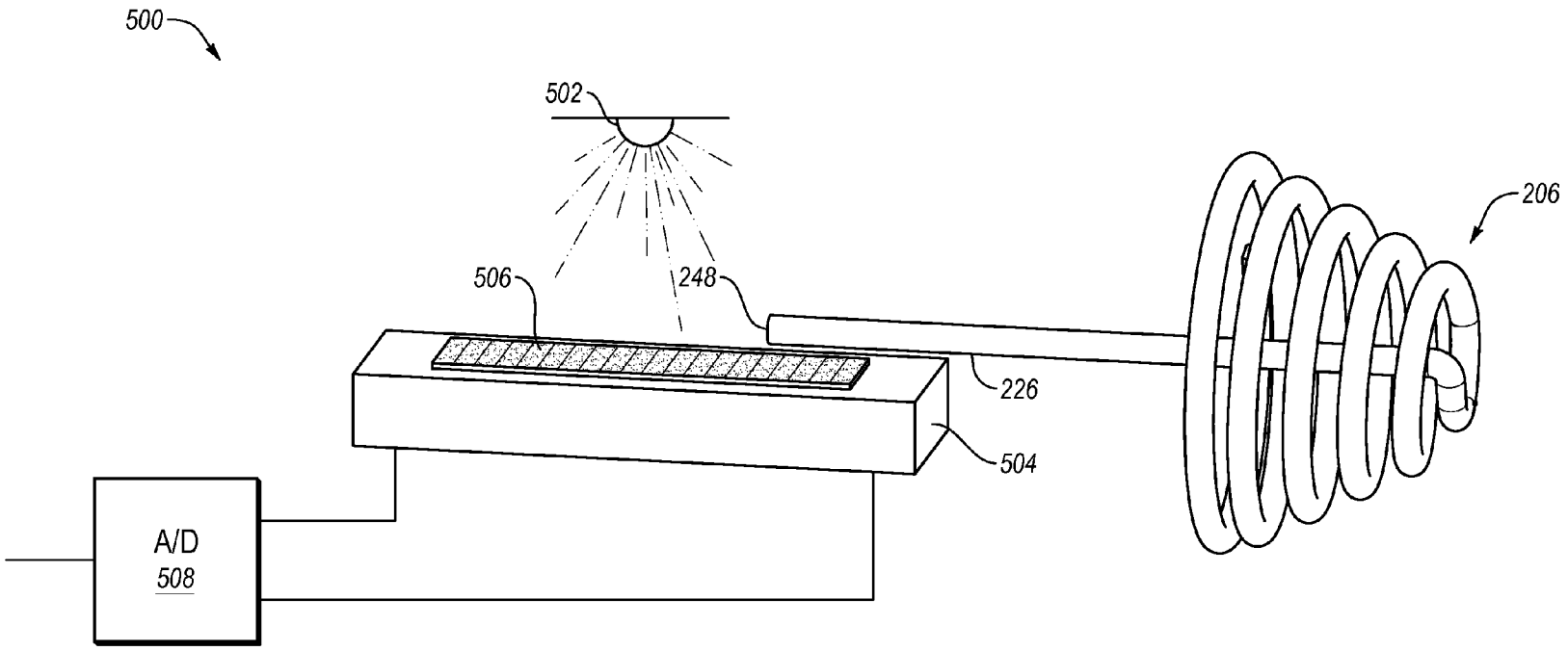
FIG. 5 is a partial schematic illustration of an example photodiode array sensor.

As disclosed schematically in FIG. 5, the example photodiode array sensor 500, which is one or many forms of optical sensors, may include a light source 502, a base 504 having a photodiode array 506 mounted thereon, and an A/D converter 508. It is noted that the photodiode array 506 may either be a two-dimensional array (i.e., a "1×Y" array) or a three-dimensional array (i.e., an "X×Y" array). As the end 248 of the rod 226 of the spring 206 is forced between the light source 502 and the photodiode array 506, the rod 226 may block the light from reaching certain of the photodiodes in the photodiode array 506, thereby allowing the photodiode array 506 and related circuitry in the base 504 to track the precise movement of the end 248 of the rod 226. The A/D converter 508 may then be employed to convert the analog signal produced by the photodiode array 506 and related circuitry in the base 504 into a digital signal. The example photodiode array sensor 500 of FIG. 5 may therefore function in a similar manner to the magnetic sensor 218 of FIGS. 2A-3C to track a current length of the spring 206.

It is further understood that the current length of the spring 206 may be tracked by a sensor with or without the use of the rod 226, such as by a sensor capable of taking a direct measurement of the current length LC of the spring 206. It is further understood that the rod 226 may be either integral with the spring 206 by being defined by the spring 206 on the first end 222 or the second end 224 of the spring 206, may be attached to or coupled to the first end 222 or the second end 224 of the spring 206, or may be attached to or coupled to another structure that is maintained at a constant distance from the first end 222 or the second end 224 of the spring 206. It is noted that where the rod 226 corresponds to the first end 222 of the spring 206 instead of the second end 224 of the spring 206, the magnetic sensor 218, or another sensor that replaces the magnetic sensor 218, would need to be moved to the other side of the spring 206, such as by being moved to be internal to the knob 202, for example.

All examples and conditional language recited herein are intended for pedagogical objects to aid the reader in understanding the example embodiments and the concepts contributed by the inventor to furthering the art, and are to be construed as being without limitation to such specifically-recited examples and conditions.

The invention claimed is:

1. A thread tensioner for a sewing machine, the thread tensioner comprising:

a first disk;

a second disk positioned next to the first disk;

a spring configured to apply tension to a thread that is positioned between the first disk and the second disk by exerting a force against the second disk, the spring defining a first end, a second end, and a length between the first end and the second end, the spring being coupled to a rod extending from the second end of the spring;

a knob configured, when rotated in a first direction, to travel along a threaded shaft toward the spring and thereby cause the length of the spring to shorten, the knob further configured, when rotated in a second direction, to travel along the threaded shaft away from the spring and thereby allow the length of the spring to lengthen; and a sensor configured to track a current length of the spring by tracking the position of the rod.

2. The thread tensioner as recited in claim 1, wherein the sensor is a photodiode array sensor.

3. The thread tensioner as recited in claim 1, wherein the sensor is a magnetic sensor.

4. The thread tensioner as recited in claim 1, wherein:

the threaded shaft is hollow; and the rod extends through the hollow shaft in order to be tracked by the sensor.

5. The thread tensioner as recited in claim 4, wherein:

the rod extends into an opening in a housing of the sensor; and the sensor is configured to track the current length of the spring by tracking the position of an end of the rod within the housing of the sensor.

6. The thread tensioner as recited in claim 1, further comprising:

a processor in electronic communication with the sensor and configured to determine a current tension that is being applied to the thread given the current length of the spring.

7. The thread tensioner as recited in claim 6, further comprising:

a display device in electronic communication with the processor and configured to display the current tension.

8. A thread tensioner for a sewing machine, the thread tensioner comprising:

a first disk;

a second disk positioned next to the first disk;

a hollow threaded shaft;

a spring configured to apply tension to a thread that is positioned between the first disk and the second disk by exerting a force against the second disk, the spring defining a first end, a second end, and a length between the first end and the second end, the spring including a rod extending from the second end of the spring and through the hollow threaded shaft;

a knob configured, when rotated in a first direction, to travel along the threaded shaft toward the spring and thereby cause the length of the spring to shorten and cause the rod to extend further through the hollow threaded shaft in inverse proportion to the shortening of the length of the spring, the knob further configured, when rotated in a second direction, to travel along the threaded shaft away from the spring and thereby allow the length of the spring to lengthen and allow the rod to retract into the hollow threaded shaft in inverse proportion to the lengthening of the length of the spring; and a sensor configured to track a current length of the spring by tracking a position of an end of the rod.

9. The thread tensioner as recited in claim 8, wherein the sensor is an optical sensor configured to optically track the position of the end of the rod.

10. The thread tensioner as recited in claim 8, wherein the sensor is a magnetic sensor configured to track the position of the end of the rod as it interacts with a magnet.

11. The thread tensioner as recited in claim 8, further comprising:

a processor in electronic communication with the sensor and configured to determine a current tension that is being applied to the thread given the current length of the spring.

12. The thread tensioner as recited in claim 11, further comprising:

a display device in electronic communication with the processor and configured to display the current tension.

13. A sewing machine comprising:

a spool holder;

a needle bar configured to have a needle attached thereto;

an electric motor configured, while the needle is threaded with a top thread from a spool on the spool holder, to repeatedly drive the threaded needle through a fabric to form a row of stitches in the fabric; and a thread tensioner comprising:

a first disk;

a second disk positioned next to the first disk;

a spring configured, while the top thread is positioned between the first disk and the second disk, to apply tension to the top thread by exerting a force against the second disk, the spring defining a first end, a second end, and a length between the first end and the second end, the spring being coupled to a rod extending from the second end of the spring;

a knob configured, when rotated in a first direction, to travel along a threaded shaft toward the spring and thereby cause the length of the spring to shorten, the knob further configured, when rotated in a second direction, to travel along the threaded shaft away from the spring and thereby allow the length of the spring to lengthen; and a sensor configured to track a current length of the spring by tracking the position of the rod;

a processor in electronic communication with the sensor and configured to determine a current tension that is being applied to the top thread given the current length of the spring; and a display device in electronic communication with the processor and configured to display the current tension.

14. The sewing machine as recited in claim 13, wherein:

the rod is integral with the spring.

15. The sewing machine as recited in claim 13, wherein:

the threaded shaft is hollow; and the rod extends through the hollow shaft in order to be tracked by the sensor.

16. The sewing machine as recited in claim 15, wherein:

the rod extends into an opening in a housing of the sensor; and the sensor is configured to track the current length of the spring by tracking the position of an end of the rod.

17. The sewing machine as recited in claim 16, wherein the sensor is a magnetic sensor configured to track the position of the end of the rod as it interacts with a magnet.

18. The sewing machine as recited in claim 15, wherein the sensor is a potentiometer sensor configured to track the position of the end of the rod as it interacts with a lever actuator.

19. The sewing machine as recited in claim 1, wherein the sensor is a potentiometer sensor configured to track the position of an end of the rod as it interacts with a lever actuator.

20. A thread tensioner for a sewing machine, the thread tensioner comprising:

a first disk;

a second disk positioned next to the first disk;

a spring configured to apply tension to a thread that is positioned between the first disk and the second disk by exerting a force against the second disk, the spring defining a first end, a second end, and a length between the first end and the second end;

a knob configured, when rotated in a first direction, to travel along a threaded shaft toward the spring and thereby cause the length of the spring to shorten, the knob further configured, when rotated in a second direction, to travel along the threaded shaft away from the spring and thereby allow the length of the spring to lengthen; and a magnetic sensor configured to track a current length of the spring.

* * * * *